US005992344A

United States Patent [19]

Bader

[11] Patent Number: 5,992,344

[45] Date of Patent: Nov. 30, 1999

[54] TOURNAMENT SCHEDULER

[76] Inventor: Silvia Bader, Reitmorstrasse 26, Munich, Germany, 80538

[21] Appl. No.: 08/982,006

[22] Filed: Dec. 1, 1997

[30] Foreign Application Priority Data

Sep. 1, 1997 [DE] Germany ..... 197 38 165

[51] Int. Cl.[6] ..... A63F 1/18

[52] U.S. Cl. ..... 116/222; 116/223; 116/325; 116/309; 116/323; 434/407; 273/DIG. 26

[58] Field of Search ..... 116/222, 223, 116/224, 225, 325, 326, 309, 319, 321, 323; 273/DIG. 26; 434/407, 430, 365; 40/491, 495, 115; 283/48.1, 49

[56] References Cited

U.S. PATENT DOCUMENTS

| | | | |
|---|---|---|---|
| 384,707 | 6/1888 | Nash | 116/222 |
| 402,700 | 5/1889 | Van Zile | 116/222 |
| 546,959 | 9/1895 | Larzelere . | |
| 1,007,854 | 11/1911 | Flanagan | 116/222 |
| 2,437,167 | 3/1948 | Lovelock . | |
| 2,463,018 | 3/1949 | Burns | 116/223 |
| 2,704,048 | 3/1955 | Perier . | |
| 3,195,813 | 7/1965 | Hart | 116/325 |
| 3,332,687 | 7/1967 | Bennett . | |
| 3,949,506 | 4/1976 | Benkowski . | |
| 4,031,850 | 6/1977 | Gantt . | |
| 4,251,936 | 2/1981 | Ferrell . | |
| 5,251,570 | 10/1993 | Creech . | |
| 5,290,043 | 3/1994 | Vidinic . | |
| 5,359,510 | 10/1994 | Sabaliauskas . | |

FOREIGN PATENT DOCUMENTS

| | | |
|---|---|---|
| 588787 | 6/1947 | United Kingdom . |

*Primary Examiner*—Andrew Hirshfeld
*Attorney, Agent, or Firm*—Oblon, Spivak, McClelland, Maier & Neustadt, P.C.

[57] ABSTRACT

What is disclosed is a tournament scheduler wherein one disk is subdivided into a multiplicity of fields, with each field being assigned to one round of the tournament. Each field is provided with a multiplicity of receptions to which markers representing a respective team each may be fastened. These markers are slidingly displaced to the fields of a next round in the course of the tournament.

17 Claims, 7 Drawing Sheets

Event Plan for the Soccer World Championship in France

PRELIMINARY ROUND

| Group A | Group B | Group C | Group D |
|---|---|---|---|
| A1 vs. A2 | B1 vs. B2 | C1 vs. C2 | D1 vs. D2 |
| A3 vs. A4 | B3 vs. B4 | C3 vs. C4 | D3 vs. D4 |
| A1 vs. A3 | B1 vs. B3 | C1 vs. C3 | D1 vs. D3 |
| A2 vs. A4 | B2 vs. B4 | C2 vs. C4 | D2 vs. D4 |
| A1 vs. A4 | B1 vs. B4 | C1 vs. C4 | D1 vs. D4 |
| A2 vs. A3 | B2 vs. B3 | C2 vs. C3 | D2 vs. D3 |

| Group E | Group F | Group G | Group H |
|---|---|---|---|
| E1 vs. E2 | F1 vs. F2 | G1 vs. G2 | H1 vs. H2 |
| E3 vs. E4 | F3 vs. F4 | G3 vs. G4 | H3 vs. H4 |
| E1 vs. E3 | F1 vs. F3 | G1 vs. G3 | H1 vs. H3 |
| E2 vs. E4 | F2 vs. F4 | G2 vs. G4 | H2 vs. H4 |
| E1 vs. E4 | F1 vs. F4 | G1 vs. G4 | H1 vs. H4 |
| E2 vs. E3 | F2 vs. F3 | G2 vs. G3 | H2 vs. H3 |

ROUND OF LAST SIXTEEN

1st Group A vs. 2nd Group B = 1
1st Group B vs. 2nd Group A = 2
1st Group C vs. 2nd Group D = 3
1st Group D vs. 2nd Group C = 4
1st Group E vs. 2nd Group F = 5
1st Group F vs. 2nd Group E = 6
1st Group G vs. 2nd Group H = 7
1st Group H vs. 2nd Group G = 8

QUARTERFINALS 1 vs. 4 = A
2 vs. 3 = B
5 vs. 8 = C
6 vs. 7 = D

SEMIFINALS

A vs. C
B vs. D

MATCH DETERMINING THIRD RANK

Semifinals losers

FINAL

Semifinals winners

Fig. 1
PRIOR ART

TOURNAMENT SCHEDULER

BACKGROUND OF THE INVENTION

FIELD OF THE INVENTION

The invention relates to a scheduler for sports tournaments organized in the elimination mode in accordance with the preamble of claim 1.

Tournaments organized in the elimination mode such as e.g. football, rugby, tennis tournaments etc. have in recent years enjoyed an increasing degree of attention in the media, with the result that these events are utilized by enterprises for placing advertisement. In recent years the trend has been even for enterprises in unrelated lines of business, i.e. those distributing products not immediately related to the respective kinds of sports, to exploit the impact of such tournaments in the media for their advertisement. Besides comparatively extensive advertisement activities such as e.g. stadium advertisement, TV commercials advertisement on contestants, garment, and selective catering to prominent entrants in VIP lounges, it is also being attempted to make use of information material related to the sports event per se as an advertisement carrier.

Particularly in major sports events as, say, a soccer world championship, comparatively complicated event plans are distributed by the organizers. A like event plan, which shall even now be referred to, is represented in FIG. 1. In these commonly distributed event plans the participants in a preliminary round are grouped, for example, in eight groups A to H. In the preliminary round the teams of one group compete against each other, with the teams finishing first and second in each group qualifying for the round of the last sixteen. In the round of the last sixteen, these first and second ranked entrants compete against each other in accordance with the system illustrated in FIG. 1, with the winners of the round of sixteen matches qualifying for the quarterfinal round which, in turn, is conducted in accordance with a predetermined pattern.

Following the quarterfinal round, two semifinal matches take place; the winning teams of the semifinals compete for the tournament victory in the final round, whereas the losing teams of the semifinals compete for rank three.

It constitutes a problem in the event plan represented in FIG. 1 that results, winners and losers of single rounds must be transferred by hand to the event program for the next round, and that as a general rule the space available for listing all the results and the present status of the tournament such as to be perceivable at one glance is very limited.

Although in the case of electronic, microprocessor supported tournament schedulers it would be possible to represent all the results in a simple manner, such schedulers are generally too expensive to be used as advertisement carriers in the corresponding quantities.

It is another drawback of the known event plans that they generally provide little space for advertising surface and are therefore merely used as information carriers but not as advertisement carriers.

For the sake of completeness it should be mentioned that the generic event plans are, as a matter of course, not only provided for team tournaments but also for tournaments of individual persons such as e.g. tennis tournaments.

The invention is based on the objective of furnishing a scheduler for sports tournaments organized in the elimination mode, which enables simple survey of the tournament status and is useful as an advertisement carrier.

This object is achieved by a scheduler having the features of claim 1.

By subdividing a scheduling area of the scheduler into several fields, with each field being reserved for one of the above described rounds (preliminary round, round of the last sixteen, quarterfinal round etc.), and providing a number of receptions, which number corresponds to the number of entrants in a respective round, and fastening a marker corresponding to one team or entrant in each reception, the spectator is capable of grasping the present tournament status in a simple manner. The markers assigned to each of the entrants are, in accordance with the match results of the single rounds transferred to a respective subsequent round, thereby doing away with the necessity of hand-written entries or filling in lists in order to keep track. As the information about the entrant or team proper is arranged on the marker, sufficient space for advertisement is preserved on the surface or back surface of the scheduler. Owing to the comparatively high quality getup of the scheduler with receptions, insertable markers etc., the target person is induced to carefully keep the scheduler, such that the applied advertisement will most likely be perceived by the addressee. A like scheduler, which can be produced in a comparatively simple manner while having a high degree of information value, is particularly well suited as a handout e.g. in the food industry.

The structure of the scheduler may be designed to be particularly compact by concentric arrangement of the fields assigned to the various rounds, with the final field having a central position, and the fields for the preceding rounds encompassing the final field. A particularly advantageous option is a circular disk shape of the scheduler surface including circular or annular fields. Needless to say, different geometries of the fields are equally applicable.

A scheduler which can be produced in a particularly simple manner is obtained by designing the marker receptions as snap-in recesses for insertion of the pin-type markers.

Manipulation of the scheduler is simplified by connecting associated fields through slide paths along which the markers may be moved to the next field.

Instead of slide paths, it is also possible to arrange adjacent fields such as to be displaceable relative to each other. In the case of annular fields, it is suitable to design every other circle area or annular area such as to be rotatable and arranged adjacent to a stationary circle area or annular area.

In order to simplify transfer of the markers to the next field, the scheduler surface may be provided with a marking—preferably color coding—determining a marker's path to the closest neighboring field.

The scheduler according to the invention may be used with particular efficiency for team tournaments such as e.g. a soccer world championship where the number of participating teams is sixteen for the first round or round of the last sixteen, eight for the quarterfinal round, and four for the semifinal round.

The group matches of a preceding preliminary round may be arranged on another disk-shaped preliminary round disk, with one radial segment subdivided into radially consecutive segment fields being assigned to each preliminary round entrant. Each segment field corresponds to one point awarded in this preliminary round, such that the results for the single entrants are recognizable by marking the segment fields from radially outside to radially inside.

In the center area of the preliminary round disk, in turn, a marking is advantageously arranged which is executed by logical combination with the next round arranged on a main round disk.

The match results may be entered e.g. on two results disks, whereby the target person can read the tournament status from the main round disk and from the individual results on the results disk.

All of the above described disks (main round disk, preliminary round disk, results disk(s)) are advantageously interconnected by suitable means such as e.g. a rotary joint, whereby the tournament scheduler is combined into a compact form.

The single scheduler disks may carry advertisement prints on their back surfaces and on the scheduler surface.

The disks are advantageously manufactured of carton or carton surrogate materials such as e.g. synthetic material.

Preferably used markers are pin-type inserts comprising a planar head which serves as an information carrier.

Further advantageous embodiments of the invention represent the subject matters of the remaining subclaims.

Here below preferred embodiments of the invention are described in detail by reference to schematic drawings, wherein.

BRIEF DESCRIPTION OF THE DRAWINGS

FIG. 1 is a conventional event plan for the imminent soccer world championship;

DESCRIPTION OF THE PREFERRED EMBODIMENT

Figure 2:
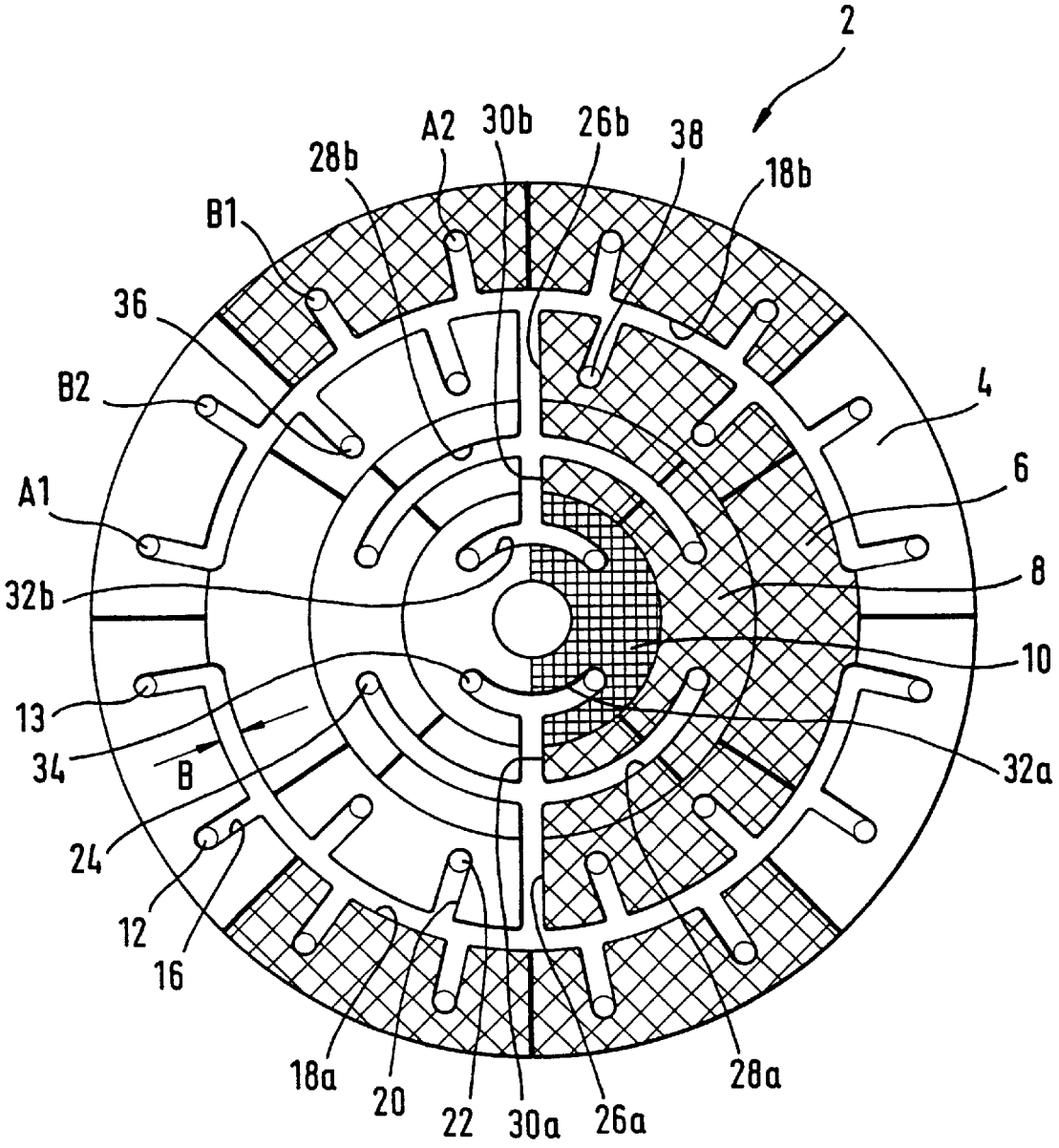
FIG. 2 is a first embodiment of a main round disk of a scheduler according to the invention.

The core element of the novel scheduler for sports tournaments organized in the elimination mode for participation by teams or single persons is a main round disk 2 represented in FIG. 2.

On this main round disk 2, practically all of the information listed in the table-type event plan of FIG. 1 under round of sixteen, quarter finals, and semifinals as well as final is contained in easily perceivable form. The main round disk 2 may e.g. be manufactured of carton or of a synthetic material having a suitable thickness. The circular-disk type main round disk 2 is subdivided into three concentric, annular fields 4, 6 and 8 encompassing a center field 10.

Each of fields 4 to 10 corresponds to one of the above named rounds, with external field 4 being assigned to the round of the last sixteen, adjacent field 6 to the quarterfinal round, and field 8 surrounding center field 10 to the semifinals. The center field 10 concerns the two final matches for determining tournament winner and third winner.

As in the present case, sixteen teams are to participate in the round of the last sixteen in the soccer championship in France, the outer field 4 is subdivided into eight segments, with two receptions 12, 13 being arranged in each segment. Each of receptions 12, 13 represents one team or one entrant in the round of the last sixteen of the tournament.

For better clarity, the receptions of the segments in a left upper position in FIG. 2 are provided with symbolic designations corresponding to the round of the last sixteen matches which are listed in the first place in FIG. 1. That is, A1 stands for No. 1 of Group A, B2 stands for No. 2 of Group B, B1 for No. 1 in Group B and A2 for No. 2 in Group A as determined in preliminary round matches. Analogously receptions 12, 13 of the other receptions are also provided with the designations (event plan according to FIG. 1) for the remaining matches of the round of the last sixteen.

One segment contains the teams to be matched in the round of the last sixteen. In the present case, this means that team B1 is to compete against team A2, and team A1 against team B2. Radial grooves 16 extend away from respective receptions 12, 13 or A1, B2, B1, A2 and join into arc-shaped grooves 18*a, b*. In the main round disk shown in FIG. 2, two arc-shaped grooves 18*a*, 18*b* are provided which are formed in the lower and upper half, respectively, of the main round disk 2 (view of FIG. 2) in the transition area between fields 4 and 6.

In the annular field 6 located inside the field 4, there are in turn formed radial grooves 20 which extend in a radial direction away from the arc-shaped groove 18*a* or 18*b* towards the inside and join into receptions 22 of the field 6. Each of receptions 22 in field 6 is reserved for one team participating in the round of sixteen, such that altogether eight receptions 22 are formed in field 6 in the case of sixteen teams participating in this round.

Radial grooves 16, arc-shaped grooves 18*a*, 18*b* and radial grooves 20 are formed such that at least one of the receptions 22 is in direct sliding path connection with one of receptions 12, 13 in the outer field 4 and may thus be reached by displacement along grooves 16, 18*a, b* and 20.

In the inner annular field 8, in turn, four receptions are formed which are reserved for the teams to participate in the semifinals. These four receptions 24 of the semifinals field 8 are formed at the terminal portions of arc-shaped connecting grooves 28*a* and 28*b* which are connected to the arc-shaped grooves 18*a* and 18*b* via radial grooves 26*a* and 26*b*, such that owing to the formed groove system another sliding path connection between the receptions 22 of field 6 (four quarterfinal round entrants) and receptions 24 of field 8 is created. In the configuration represented in FIG. 2, the receptions 22 connected with the arc-shaped groove 18*a* are connected to the connecting groove 28*a* via the radial groove 26*a*, and analogously the arc-shaped groove 18*b* is connected to the connecting groove 28*b* via radial groove 26*b*.

The center field 10 assigned to the final round in turn includes two arc-shaped central grooves 32*a*, 32*b* which are connected to the connecting groove 28*a* and 28*b* via radial grooves 30*a*, 30*b*. At the ends of each central groove 32*a, b*, receptions 34 are formed which are assigned to one final entrant each. The receptions 34 arranged in the center field 10 are also connected to the receptions 24 of field B via the groove system (30*a,b*; 32*a,b*).

As can be seen from the above explanations, the receptions 12, 13, 22, 24 and 34 are each arranged at the terminal portions of grooves, with adjacent receptions within one field representing one match which can be found in the event plan in accordance with FIG. 1.

The groove system represented in FIG. 2 does, however, allow for several paths to reach the receptions of the next field having a radially inner location. In order to prevent errors upon movement along the groove system, the main round disk 2 is additionally provided with a color coding which is characterized by hatched and non-hatched areas in the representation according to FIG. 2. Accordingly, the main round disk 2 comprises on the annular fields 4, 6 and 8 two color-coded areas, each kind of area being illustrated as a cross-hatched area and a non-hatched area respectively. The center field 10 also comprises two areas—one non-hatched area and an area having a narrow double hatching. The latter is assigned to the final match, whereas the non-hatched area of the center field 10 is assigned to the match determining third rank. Instead of hatching, various coloring or other markings such as e.g. embossing in the material may, of course, be provided. The markings make it easier for the user to identify associated receptions.

Thus e.g. the match A1 vs. B2 is to be found in a non-hatched area, with the related reception of the next round or of the next field being the closest one also being accessible in a non-hatched area of field 6. This reception, which is assigned to the match A1 vs. B2, is provided with reference numeral 36 in the representation according to FIG. 2. The match B1 vs. A2 is located in a hatched area, with the related reception of field 6 accordingly also having to be located in a hatched area. The closest accessible reception is for accommodating the winner of match B1 vs. A2 is identified by reference numeral 38 in the representation of FIG. 2. Owing to this color coding, related receptions of the single rounds (last sixteen quarter finals and semifinals; final) are readily identifiable, with errors in associating the individual receptions being virtually precluded.

Figure 3:
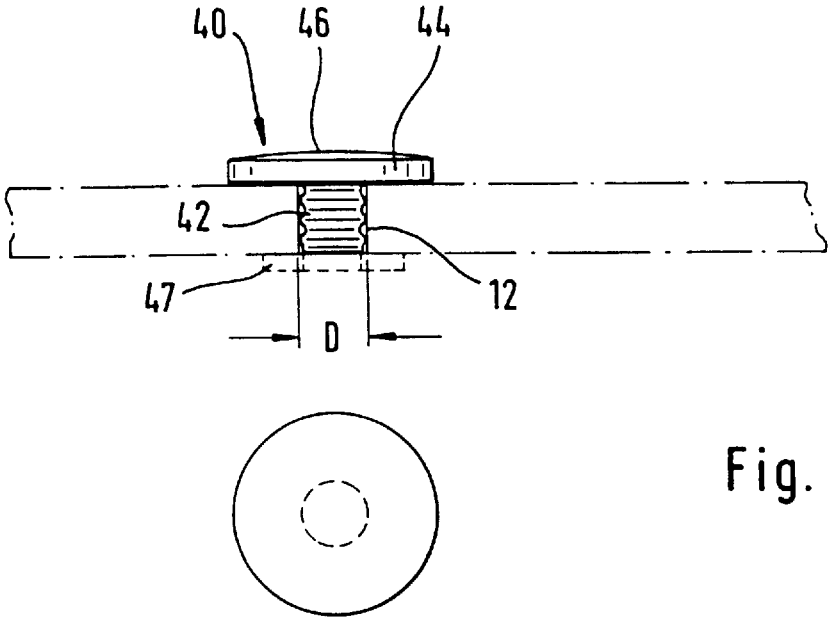
FIG. 3 is a pin usable with the disks in accordance with FIG. 2.

At the beginning of the round of the last sixteen, the receptions 12, 13 of the single sectors of the outer ring 4 are provided with markers, e.g. with pins 40 as represented in FIG. 3. These pins 40 include a snap-in bolt 42 which may be precisely press-fitted into one of the above named receptions, e.g. reception 12. The geometry of snap-in bolt 42 is selected such that the pin can be removed from the reception 12 only by application of a predetermined force, with inadvertent removal of the pin 40 from the receptions being precluded. This fitting accommodation of snap-in pin 40 may e.g. be effected in such a way that the receptions are executed at a slightly reduced size in elastically deformable materials, e.g. carton, with the snap-in bolt 42 being impressible into the material. For better introduction of the snap-in bolt 42 the latter may be provided with cutting teeth. The pin 40 comprises a head 44 having an increased surface area relative to the snap-in bolt 42 which is supported at its bottom side on the major surface of the main round disk 2, and whose major surface 46 facing away from the main round disk 2 is an information carrier. This major surface 46 may e.g. be printed with the national colors or with the logo of a team, thus making it possible to identify the team represented by this pin 40 at first glance. The width B of grooves 18*a, b*, 20, 26*a, b*, 28*a, b*, 30*a, b* and 32*a, b* is preferably selected to be somewhat greater than the diameter D of the reception (FIG. 3), such that pin 40 can be displaced along the groove system without requiring a particular force in order to get from one reception to the associated reception of the following round. As is indicated in FIG. 3 by a broken line, the pin 40 can be secured against dropping out by a plug-type counterpiece 47. It is also conceivable to guide slide members receiving the pins in the slide paths.

As was mentioned above, the receptions 12, 13 of the ring 4 are initially occupied by sixteen pins 40 each assigned to one of the teams participating in the round of sixteen. The match opponents result from those receptions arranged in the eight sectors. The pin assigned to the winner of a respective match in the round of sixteen is then, in accordance with the color coding and the groove system, moved to the corresponding reception of the next field 6, to thereby identify the opponents in the quarterfinal matches. The losers remain in their respective fields, whereby it is easily recognizable which teams have been eliminated from the tournament or advanced to the next round. The winners of the quarterfinal matches are then, again in accordance with the groove system and the color coding, moved into the four receptions 24 of the inner annular field 8, with the opposed receptions 24 at the terminal portions of the arc-shaped connecting grooves 28*a, b* characterizing the semifinal matches. The two winners of these semifinal matches are then moved along the groove system 30*b*, 32*b* and 30*a*, 32*a* into the closely hatched portion of center field 10 while the pins 40 assigned to the two losers are moved into the two remaining receptions 34 in the non-hatched portion of center field 10, such that the finals opponents are characterized by the corresponding pins 40.

By means of the above described system, it is possible in a simple manner to gain an overview over the status of the tournament, with the pin 40 assigned to the losers remaining in the receptions of that round in which the losers were eliminated. The pins 40 assigned to the winners are moved to the respective inner fields whereby the performance of a team in the tournament can be deducted from the positions of the pins 40 in the respective fields.

In a simplified embodiment, the grooves represented in FIG. 2 and providing connection between the single receptions 12, 13, 22, 24 and 34 may be left away, thereby making it necessary to remove and reposition the pins. Basically this embodiment would, however, function in the same manner as the above described embodiment.

Figure 4:
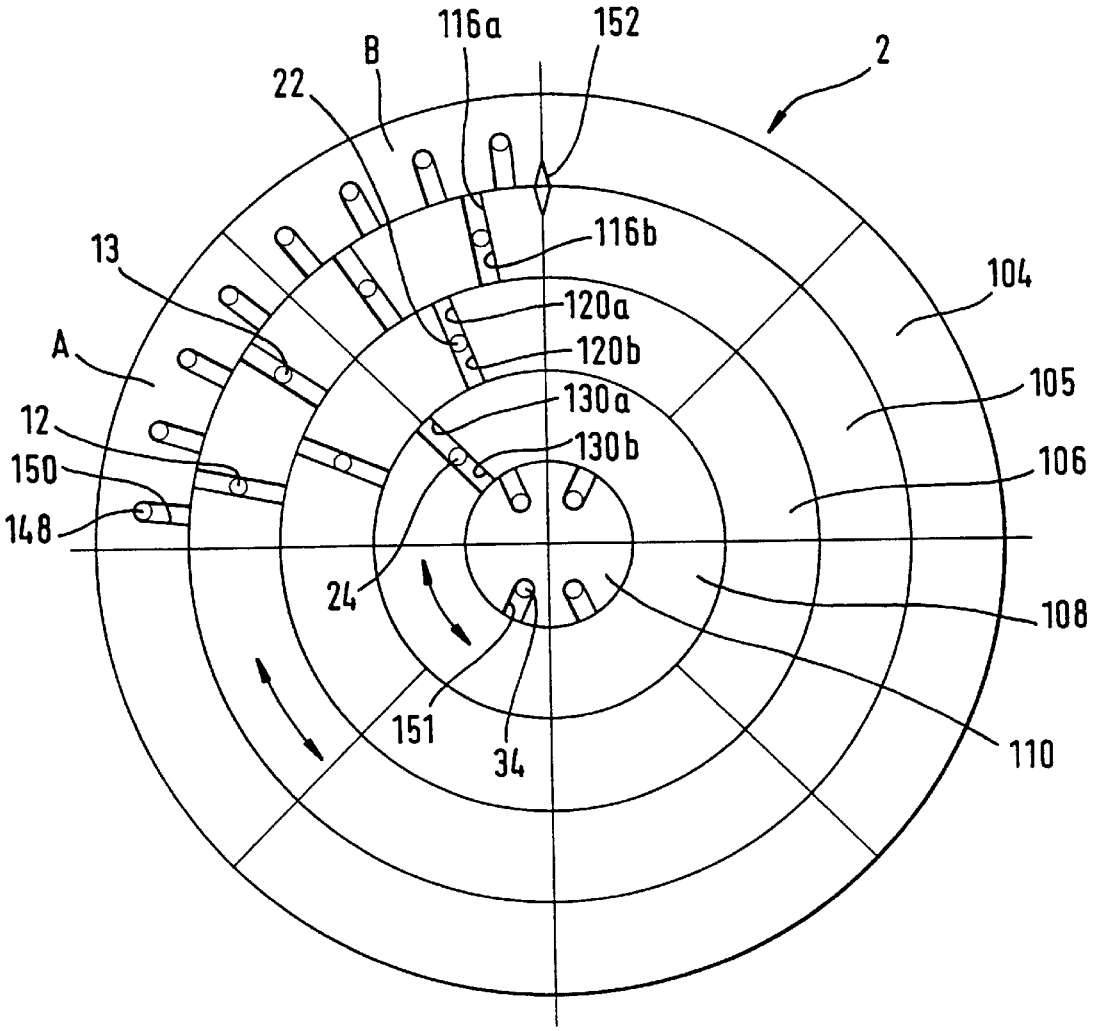
FIG. 4 is another embodiment of a main round disk.

FIG. 4 represents another embodiment of a main round disk 2 according to the invention, with only the receptions of the sectors on the top left side being represented in FIG. 4 for the sake of simplicity.

Just like in the above described embodiment, the main round disk is of circular shape and comprises four annular fields 104, 105, 106 and 108 encompassing a center field 110. In the embodiment represented in FIG. 4 an additional external annular field 104 is provided which is assigned to the preliminary round matches. Analogously this field 104 assigned to the preliminary round is formed to include thirty-two receptions 148 in total, with each reception being assigned to one participant in the preliminary round. A radial groove 150 extends in an inwardly direction from the reception 148 towards the peripheral edge of the adjacent field 105.

In this adjacent field 105 assigned to the round of sixteen matches, a total of sixteen receptions 12, 13 are arranged in accordance with field 4 in the representation of FIG. 2, two of which are each provided in one sector. Inside the next inner annular field 106, in total eight receptions 22 each assigned to two receptions 22 of field 105 are arranged.

In the inner annular field 108, finally, four receptions 24 are provided, one of which each is assigned to two receptions of adjacent field 106. Each of receptions 12, 13, 22, 24 is connected to the adjacent fields via radial groove portions 116*a*, 116*b* or 120*a*, 120*b* or 130*a*, 130*b*.

The center field 110 comprises receptions assigned to the two final matches, starting from which radial grooves 151 extend to the adjacent annular field 108.

In the embodiment represented in FIG. 4, the annular fields 105 and 108 are arranged rotatably relative to the remaining fields 104, 106 and 110. In order to enable such rotation, e.g. a carrier disk not represented here may be provided, on which the stationary fields 104, 106 and 110 are fastened and on which the rotatable fields 105 and 108 are mounted rotatably, The scheduler surface of main round disk 2 or, more precisely, of the fields 104, 105, 106, 108 and 110 in turn is provided with a marking as indicated in FIG. 2. For the sake of clarity this marking was, however, omitted in the representation of FIG. 4.

Prior to the beginning of the preliminary round, receptions 148 of the preliminary round field 104 are provided with the markers each assigned to one team, e.g. the pins 40 represented in FIG. 3. As was mentioned above, the members of one group (Groups A to H) are arranged in one sector each of field 104. The two highest-ranking members of each group (A to H) advance to the round of the last sixteen which is characterized by the rotatable field 105. In order to move the pins 40 of the two highest-ranking entrants in a group from field 104 to field 105, a respective one of receptions 12 and 13 is taken into a transfer position with the receptions 148 occupied by the group winners by rotating field 105. This transfer position is attained as soon as the radial groove 150 of the respective reception 148 is aligned with the radial groove 116*a* of the associated reception 12 or 13 of the associated field 105. Subsequently the pin is moved along the radial grooves 150, 116*a* into the corresponding reception 12 or 13, whereby the opponents of the round of sixteen matches are identifiable on the rotatable ring 105. The latter is then taken into a predetermined basic position relative to the stationary fields 104, 106 and 110. This basic position may be marked e.g. by a marking 152 on the fields 104 and 105 which must be made to match.

The pins 40 assigned to the winners in the round of sixteen in receptions 12, 13 are then moved by suitably rotating the field 105 and displacement along radial grooves 116*b*, 120*a* into the assigned receptions 22 of field 106 which is assigned to the quarterfinal matches. The quarterfinal opponents are predetermined by mutually adjacent receptions 22 which are located in one sector of field 106.

The winners of these quarterfinal matches are then moved into the assigned receptions 24 by suitably rotating the inner field 108. This displacement is carried out along the respective radial grooves 120*b*, 130*a* arranged in alignment with each other.

The winners of the semifinals matches are then, by corresponding rotation of field 108 and displacement of pins 40 along aligned radial grooves 130*b*, 151, taken into the associated area of the center field 110.

In the above described embodiment it is not necessary to form the circular grooves in accordance with FIG. 2 inasmuch as the pins may be displaced by moving the rotatable fields 105 and 108 and corresponding alignment of the radial grooves. As a matter of course, the embodiment according to FIG. 4 may, in analogy with the embodiment of FIG. 2, also be designed to include only three annular fields, with the preliminary round matches not being contained on the main round disk 2. In an embodiment of this type, field 105 would consequently be the outer field, and inner fields 106 and 110 might for instance be designed to be rotatable with respect to the two stationary fields 105 and 108.

Although the preliminary round contestants are in the above described embodiment arranged on the outer field 104, the preliminary round disk does not yield any information concerning the preliminary round.

Figure 5:
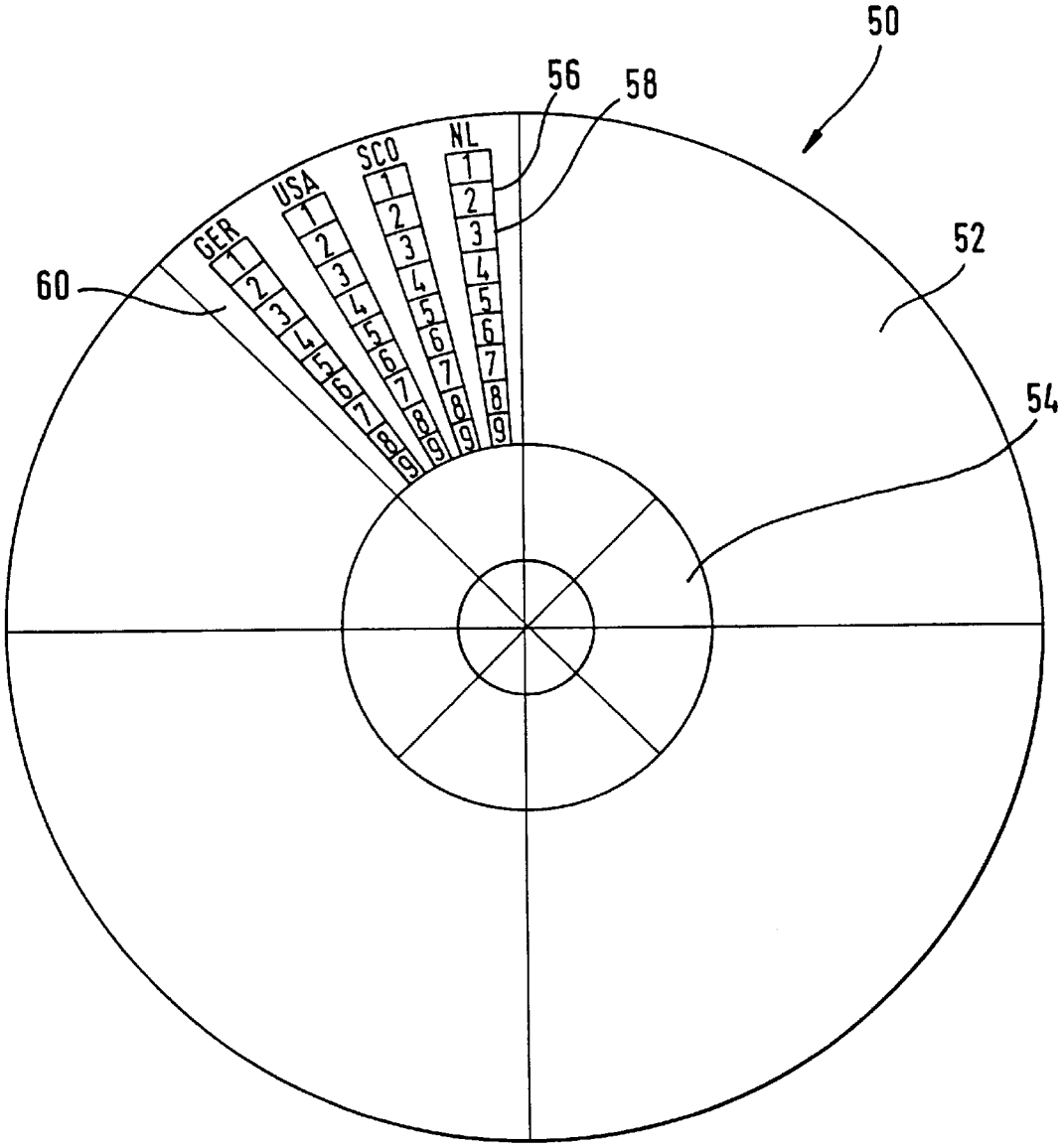
FIG. 5 is a preliminary round disk for a scheduler according to the invention.

In order to obtain a better overview over the development of the tournament, the scheduler is executed such as to include a preliminary round disk 50 in accordance with FIG. 5, which is subdivided into an outer ring 52 and an inner ring 54 or a center area. The outer ring 52 is provided with radial segments 56, each of which is assigned to one of the teams participating in the preliminary round. Accordingly, a total of thirty-two radial segments 56 are uniformly distributed on the circular ring 52. Each radial segment 56 is in the shown embodiment subdivided into nine segment fields 58, with each segment field 58 representing one obtainable point in the preliminary round. For example, one point is awarded for a draw, whereas three points are gained by a victory. Inasmuch as four teams each are included in one group, and each of these groups accordingly has to play three preliminary round matches, a preliminary round team can obtain a maximum of nine points. By means of these radial segments 56 and segment fields 58 the preliminary round status in the respective groups may be represented with relative ease if the points of the single teams of each group (e.g. Germany, USA, Scotland, Netherlands) are marked by crossing the segment fields 58 in accordance with the number of points obtained by each team. Those two teams in each group whose segment fields 58 extend furthest in a radial inward direction are the two group winners and advance to the next round (round of last sixteen). The entrants in a preliminary group are arranged in a sector 60 on the preliminary round disk 50. In order to facilitate transition to the subsequent main round disk, the inner ring 54 is provided with a marking, preferably a color coding, which corresponds to the one described by reference to the embodiment of FIG. 2.

Figure 6:
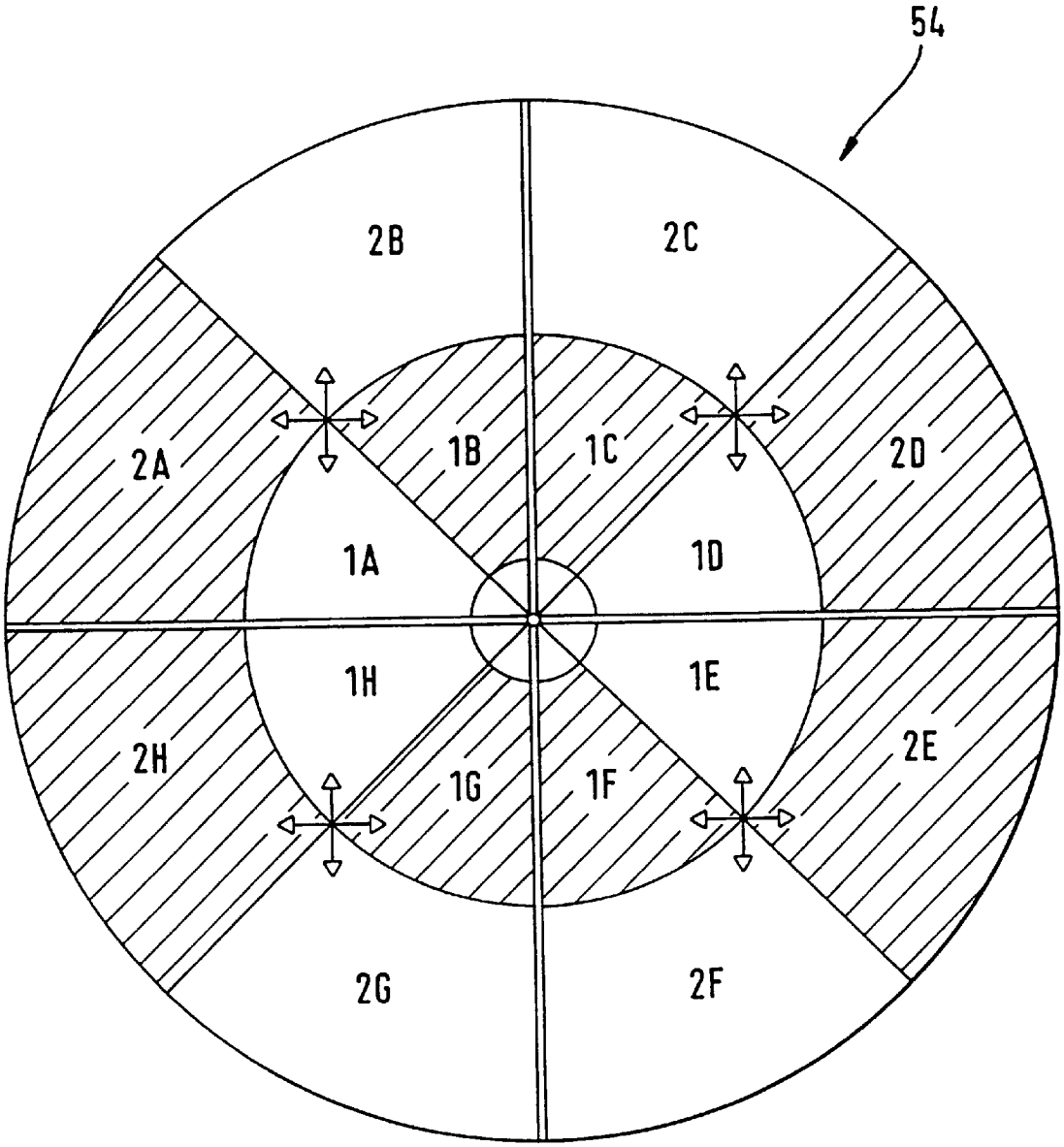
FIG. 6 is an enlarged representation of the center area of the preliminary round disk of FIG. 5.

The inner ring 54 is shown in an enlarged representation in FIG. 6. Accordingly, this inner ring 54 is subdivided into sixteen partial segments each of which is assigned to one round-of-sixteen entrant. This allocation is performed in the representation of FIG. 6 by short designation 1A, 2A, 1B, 2B, . . . , 1H, 2H, with the letter representing the group and the numeral indicating ranking after the preliminary round matches. The inner ring 54 is subdivided into four quarter circles by the double lines, such that four teams are arranged in each quarter circle. The match opponents of the round of sixteen result from the arrangement inside these quarter circles, with teams arranged in hatched areas and in non-hatched areas pairing off as indicated by the crossed arrows.

I.e., in the quarter circle located on the top left in FIG. 6, teams 1A and 2B and 1B and 2A meet. These matches are then found again on the outer annular field 4 in the main round disk in accordance with FIG. 2, with this field being provided analogously with the inner ring 54 with hatching, color coding or another type of marking, whereby transferring the results from the preliminary round disk 50 to the main round disk 2 is very simple.

In addition to the two above described disks 2, 50, the scheduler in accordance with the invention may furthermore be provided with one or two results disks 62, 64 on which the tournament results may be recorded in a conventional manner by writing. For this purpose disks 62, 64 are e.g. provided with inscribable fields which are filled in in the course of the tournament.

Figure 7:
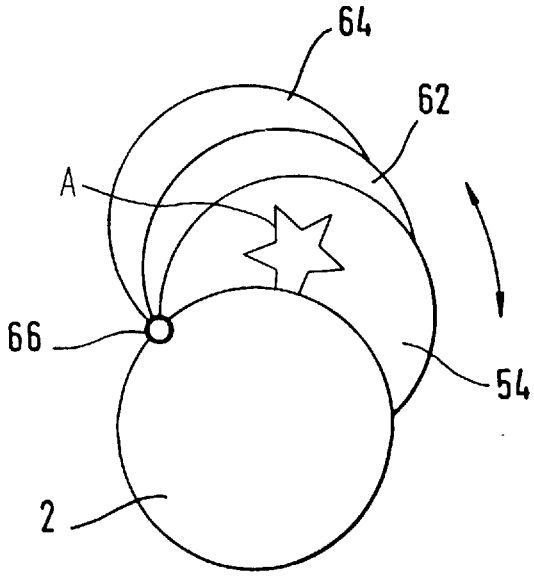
FIG. 7 is a drawing showing the configuration of the scheduler according to the invention.

As is indicated in FIG. 7, the single disks, e.g. disks 2, 50, 62 and 64 as well as cover disks not represented here may be connected to each other by means of a rotary joint which may e.g. have the form of a through-bolt penetrating the rim area of the disks 2, 50, 62, 64 arranged on top of each other, and which is secured against slipping from the stacked disks. The single disks may then, as is indicated by the arrows in FIG. 7, be opened in the manner of a fan to make the information contained on the disks accessible. The rear faces of the disks as well as partial areas of the major surfaces of disks 2, 50, 62 and 64 shown in the above mentioned figures, as well as of the cover disks not represented here, may be printed with an advertisement A such that the tournament scheduler performs a double function as an advertisement carrier and as a carrier of information about the progress of the tournament. The through-bolt may have the form of a hollow bolt through which a string can be threaded to make the tournament scheduler into a pendant.

Figure 8:
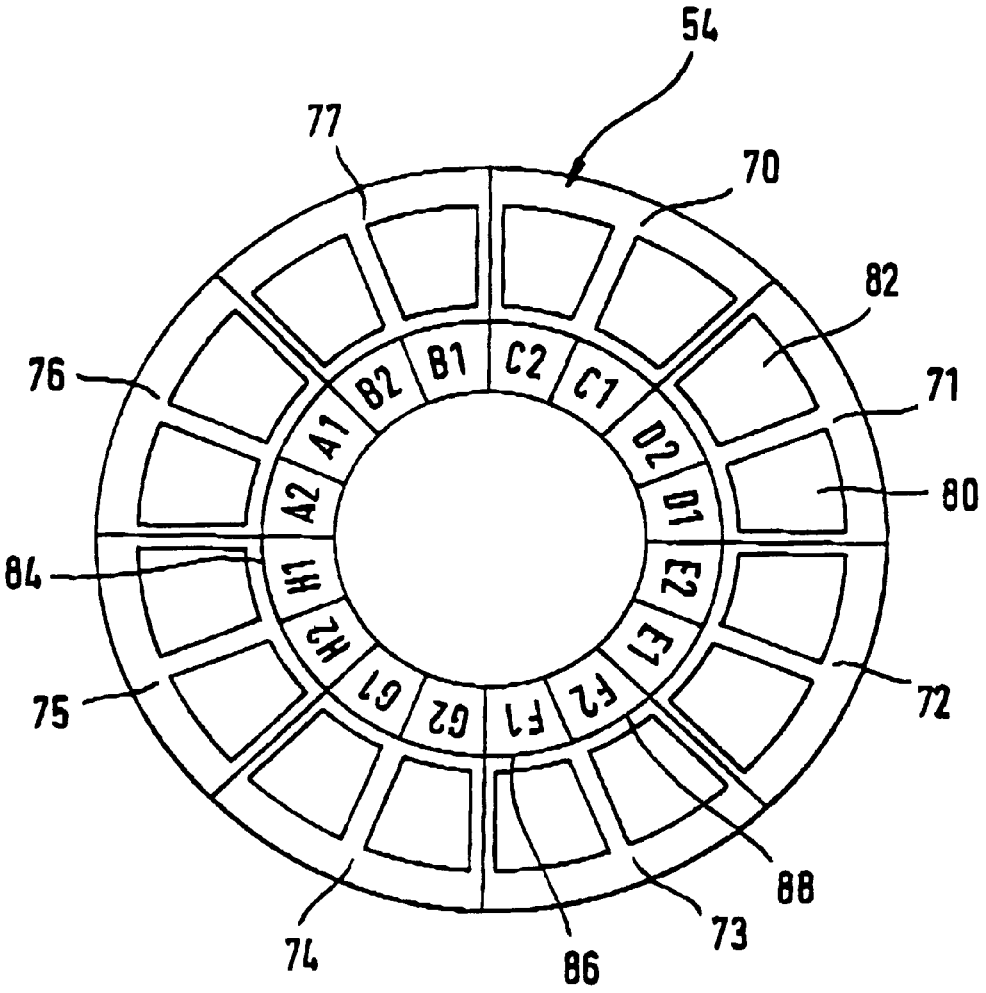
FIG. 8 is another embodiment of a main round disc.

FIG. 8 represents the inner area—also referred to as inner ring 54—of an alternative embodiment of a preliminary round disk. As this preliminary round disk differs from the above described embodiment merely in the design of inner ring 54, a repeated description of the outer portions shall be omitted.

Similarly with the above described embodiment, the inner ring is again subdivided into eight segments 70 to 77, with two reserved fields 80, 82 having the form of truncated pyramids being arranged in one segment, wherein the first-ranking and second-ranking contestants of the preliminary round can be entered, or on which corresponding markers may be fastened.

The inner ring 54 moreover comprises a center ring 84 surrounded by the reserved fields 80, 82. Each field delimited by a circle Segment 70 to 77 and the inner ring 84 is subdivided into two inner segment fields 86, 88 into which the short designations A1, A2, . . . , H1, H2 for the first and second ranking entrants in a group are entered. The inner segment fields 86, 88 in turn are provided with the above described marking (e.g. color coding) whereby simple transfer of the preliminary round results to the main round disk is made possible.

The color coding may, for example, be executed as shown in

TABLE 1

| | | | | | | | | |
|---|---|---|---|---|---|---|---|---|
| BLUE | A1 | B2 | C2 | D1 | E1 | F2 | G2 | H1 |
| RED | A2 | B1 | C1 | D2 | E2 | F1 | G1 | H2 |

By the measures according to the invention, a tournament scheduler is created which commands a high degree of informational content on minimum space and which permits to obtain a rapid overview over the status of a tournament.

What is disclosed is a tournament scheduler in which a disk is subdivided into a multiplicity of fields, with each field being assigned to one round of the tournament. Each field is provided with a multiplicity of receptions to which markers assigned to a respective team may be fastened. These markers are advanced to the fields of a next round in the course of the tournament.

What is claimed as new and desired to be secured by Letters Patent of the United States is:

1. A scheduler for a sports tournament organized in the elimination mode wherein entrants compete in a first round, the winners of the first round advance into at least one subsequent round, the losers are eliminated or further compete in a parallel round, and the winners in the at least one subsequent round correspondingly compete against each other to determine at least two final round participants, with said scheduler including a listing of the entrants in the first round and a scheduler area for the entrants in the at least one subsequent round, said scheduler comprising:

a first disk including aid scheduler area;

a first-round field corresponding to said first round of the tournament and a plurality of further fields each corresponding to one of said at least one subsequent round following said first round, all said fields being defined in said scheduler area;

a plurality of receptions formed in said first-round field defined in said scheduler area, and additional receptions formed in each of said further fields defined in said scheduler area for winners of an immediately preceding round, said receptions of each field are grouped into pairs of two and the number of said receptions diminishes by half for each successive field when starting from said first-round field; and a plurality of markers, each of which is assigned to one first-round entrant and held in one of the receptions of said first-round field, and each of said plurality of markers is movable from one reception in one field to another one in a neighboring field, said movement of each of said plurality of said markers taking place when a competition is won wherein said receptions are recesses, and said markers are pins received in said recesses with recesses associated with each field being connected with each other by slide paths.

2. The scheduler according to claim 1, wherein said fields have a concentric arrangement, with a final round field of said plurality of further fields having a central arrangement and the fields of previous rounds being arranged consecutively in an outwardly direction.

3. The scheduler according to claim 2, wherein said scheduler area has a circular disk shape, with said final round field being a circular area and the remaining fields being annular areas.

4. The scheduler according to claim 3, wherein said disk is punched parts of carton or synthetic material.

5.The scheduler according to claim 1, wherein each one of said fields is defined by at least two different markings such that said each one field is subdivided such as to predetermine the path of entrants associated with each one of said at least two different markings from the first round to a final round.

6. The scheduler according to claim 5, wherein said marking is a color coding.

7. The scheduler according to claim 1, further comprising at least one results disks associated with said first disk.

8. The scheduler according to claim 1, wherein the number of receptions is 16 for the first round, and wherein said subsequent rounds include 8 receptions for a quarter final round, 4 for a semi-final round and 2 for a final round.

9. A scheduler for a sports tournament organized in the elimination mode wherein entrants compete in a first round, the winners of the first round advance into at least one subsequent round, the losers are eliminated or further compete in a parallel round, and the winners in the at least one subsequent round correspondingly compete against each other to determine at least two final round participants, with said scheduler including a listing of the entrants in the first round and a scheduler area for the entrants in at least one subsequent round, said scheduler comprising:

a first disk including said scheduler area;

a first-round field corresponding to said first round of the tournament and a plurality of further fields each corresponding to one of said at least one subsequent round following said first round, all said fields being defined in said scheduler area;

a plurality of receptions formed in said first-round field defined in said scheduler area, and additional receptions formed in each of said further fields defined in said scheduler area for winners of an immediately preceding round, said receptions of each field are grouped into pairs of two and the number of said receptions diminishes by half for each successive field when starting from said first-round field; and a plurality of markers, each of which is assigned to one first-round entrant and held in one of the receptions of said first-round field, and each of said plurality of markers is movable from one reception in one field to another one in a neighboring field, said movement of each of said plurality of said markers taking place when a competition is won wherein said scheduler area has a circular disk shape, with said final round field being a circular area and the remaining fields being annular areas, wherein adjacent fields are slidingly displaceable relative to each other.

10. The scheduler according to claim 9 wherein said receptions are recesses, and said markers are in the form of pins received in said recesses.

11. The scheduler according to claim 10, wherein ones of said recesses associated with each field are connectable with each other by slide paths.

12. The scheduler according to claim 10, wherein each of said pins include a pin-shaped snap-in bolt and a planar head including a base surface carrying information.

13. A scheduler for a sports tournament organized in the elimination mode wherein entrants compete in a first round, the winners of the first round advance into at least one subsequent round, the losers are eliminated or further compete in a parallel round, and the winners in the at least one subsequent round correspondingly compete against each other to determine at least two final round participants, with said scheduler including a listing of the entrants in the first round and a scheduler area for the entrants in the at least one subsequent round, said scheduler comprising:

a first disk including said scheduler area;

a first-round field corresponding to said first round of the tournament and a plurality of further fields each corresponding to one of said at least one subsequent round following said first round, all said fields being defined in said scheduler area;

a plurality of receptions formed in said first-round field defined in said scheduler area, and additional receptions formed in each of said further fields defined in said scheduler area for winners of an immediately preceding round, said receptions of each field are grouped into pairs of two and the number of said receptions diminishes by half for each successive field when starting from said first-round field; and a plurality of markers, each of which is assigned to one first-round entrant and held in one of the receptions of said first-round field, and each of said plurality of markers is movable from one reception in one field to another one in a neighboring field, said movement of each of said plurality of said markers taking place when a competition is won, said scheduler further comprising a preliminary round disk associated with said first disk having preliminary round entrants arranged on radial segments, with each radial segment being subdivided into a multiplicity of radially consecutive segment fields wherein preliminary rounds occur prior to said first round.

14. The scheduler according to claim 13, wherein said preliminary round disk is provided with an indicator marking in a center area.

15. The scheduler according to claim 13, wherein said preliminary round disk is provided with a preliminary round marking in a center area.

16. A scheduler for a sports tournament organized in the elimination mode wherein entrants compete in a first round, the winners of the first round advance into at least one subsequent round, the losers are eliminated or further compete in a parallel round, and the winners in the at least one subsequent round correspondingly compete against each other to determine at least two final round participants, with said scheduler including a listing of the entrants in the first round and a scheduler area for the entrants in the at least one subsequent round, said scheduler comprising:

a first disk including said scheduler area;

a first-round field corresponding to said first round of the tournament and a plurality of further fields each corresponding to one of said at least one subsequent round following said first round, all said fields being defined in said scheduler area;

a plurality of receptions formed in said first-round field defined in said scheduler area, and additional receptions formed in each of said further fields defined in said scheduler area for winners of an immediately preceding round, said receptions of each field are grouped into pairs of two and the number of said receptions diminishes by half for each successive field when starting from said first-round field; and a plurality of markers, each of which is assigned to one first-round entrant and held in one of the receptions of said first-round field, and each of said plurality of markers is movable from one reception in one field to another one in a neighboring field of said further fields, said movement of each of said plurality of said markers taking place when a competition is won, said scheduler further comprising at least one results disk associated with said first disk, wherein each of said at least one results disk and said first disk are connected together by a rotary joint arranged at a peripheral edge of each disk for opening said disks from a position where they cover each other in the manner of a fan.

17. The scheduler according to claim 16, wherein each of said disks carry an advertisement print on one of a first surface and a rear surface of each of said disks.

* * * * *